US006929261B2

(12) United States Patent
Nelson et al.

(10) Patent No.: US 6,929,261 B2
(45) Date of Patent: Aug. 16, 2005

(54) FEED ROLLER MECHANISM

(75) Inventors: Brian D. Nelson, Saint Paul, MN (US); Troy A. Giese, Hugo, MN (US)

(73) Assignee: Eastman Kodak Company, Rochester, NY (US)

( * ) Notice: Subject to any disclaimer, the term of this patent is extended or adjusted under 35 U.S.C. 154(b) by 57 days.

(21) Appl. No.: 10/375,964

(22) Filed: Feb. 28, 2003

(65) Prior Publication Data

US 2004/0169330 A1 Sep. 2, 2004

(51) Int. Cl.[7] ..... B65H 5/02
(52) U.S. Cl. ..... 271/273; 271/274
(58) Field of Search ..... 271/273, 274; 74/48, 50; 198/624

(56) References Cited

U.S. PATENT DOCUMENTS 4,496,339 A * 1/1985 Moll ..... 493/420
5,029,845 A * 7/1991 Simpson-Davis ..... 271/262
5,221,035 A 6/1993 Suzuki et al.
5,762,332 A * 6/1998 Haroutel et al. ..... 271/274
6,260,842 B1 7/2001 Nelson et al.
6,598,870 B2 * 7/2003 Hanano ..... 271/138
6,682,069 B2 * 1/2004 Shibabuki ..... 271/274
2004/0080103 A1 * 4/2004 Lyga et al. ..... 271/273

FOREIGN PATENT DOCUMENTS

DE 3545304 7/1987
EP 0 336 674 10/1989

* cited by examiner

*Primary Examiner*—David H. Bollinger
(74) *Attorney, Agent, or Firm*—William F. Noral

(57) ABSTRACT

An apparatus for transporting a sheet comprising: a first roller; a second roller; and an assembly for mounting the second roller for movement between a position spaced from the first roller and a position engaging the first roller for transporting a sheet; wherein the second roller has first and second ends, and wherein the assembly includes independently spring loaded link assemblies respectively on the first and second ends of the second roller that ensure that the second roller will always close down on both sides of the first roller with uniform pressure on both sides.

11 Claims, 7 Drawing Sheets

FEED ROLLER MECHANISM

FIELD OF THE INVENTION

This invention relates in general to laser imagers and more particularly to an improved feed roller mechanism forming part of the film transport system.

BACKGROUND OF THE INVENTION

Laser imagers are widely used in the medical imaging field to produce visual representations on film of digital medical images. Laser imagers typically include a film supply and transport system, a film exposure system, and a film processing system. The film supply and transport system includes a supply of unexposed film stacked in a cartridge or magazine, a mechanism for removing individual sheets of film and delivering each sheet to a film transport system. The film transport system then transports the film through the film exposure and film processing systems to an output tray for access by a user.

U.S. Pat. No. 6,260,842, issued Jul. 17, 2001, inventors Nelson et al. disclose a film supply system for use with a resealable film cartridge containing a stack of unexposed film. The film supply system includes a mechanism for unsealing the cartridge and a mechanism for separating and delivering individual film sheets to the film transport system. As disclosed, the top film is gripped by a suction cup mechanism, the film is bent and the film is separated from the next adjacent film in the stack and delivered to a feed roller pair. Initially, the film contacts the lower drive roller, the upper idler roller being held out of contact with the lower roller. Then, the rollers are driven closed to secure the film. The rollers are now driven to transport the film away from the film supply system.

Although successful for its intended purposes, the disclosed feed roller mechanism evidenced certain features that needed improvement. These include the following:

1. The idler roller would not clamp evenly across the drive roller.

2. The motor was under load while the idler roller was in the open position, making it susceptible to closing when the motor was not energized.

3. Link mechanisms in the front of the mechanism made it difficult to clear films in the assembly.

4. The stack height of the mechanism was to high for the synergy application.

SUMMARY OF THE INVENTION

According to the present invention, there is provided a solution to these problems.

According to a feature of the present invention, there is provided an apparatus for transporting a sheet comprising: a first roller; a second roller; and an assembly for mounting said second roller for movement between a position spaced from said first roller and a position engaging said first roller for transporting a sheet; wherein said second roller has first and second ends, and wherein said assembly includes independently spring loaded link assemblies respectively on said first and second ends of said second roller that ensure that said second roller will always close down on both sides of said first roller with uniform pressure on both sides.

ADVANTAGEOUS EFFECT OF THE INVENTION

The invention has the following advantages.

1. Independent Spring Loaded Links

The feed roller mechanism utilizes independently spring loaded links on each end of the idler roller. This ensures that the idler roller will always close down on both sides of the drive roller with uniform pressure on each side. This prevents possible film skew during film feed due to a possible roller gap on one side of the mating pair of rollers that can occur in a rigid idler roller mechanism.

2. No load on Motor in Open and Closed Positions

Traditional open/close feed roller designs utilize torsion springs with the highest spring load in the max open roller position. The Synergy feed roller mechanism utilizes compression springs that only actuate, with a resulting motor load, in the roller close position. The motor stops in the roller closed position when the idler gear and rocker arm is in a toggle position which is also a no-load condition on the motor. This means that the open and closed feed roller positions will no slip out of position due to motor loading conditions when the motor is powered down or idled.

3. Mechanism is Above the Film Plane—Easy Jam Clearance

The mechanism for the feed rollers that resides in the film area is all above the film feed path. This enables a clear, unobstructed removal of any film that has jammed in the assembly.

4. Low Profile Design

The feed roller mechanism is a very low profile design which facilitates the stacking of multiple film feed assemblies without a major impact on the overall height of the imager. Multiple feed magazines allow multiple film sizes to be on-line and ready to feed film into the imager. In the case where multiple stacked film feed magazines. Every inch saved in the height of the feed roller assembly saves 3 inches on the overall height of the imager.

DETAILED DESCRIPTION OF THE INVENTION

Figure 1:
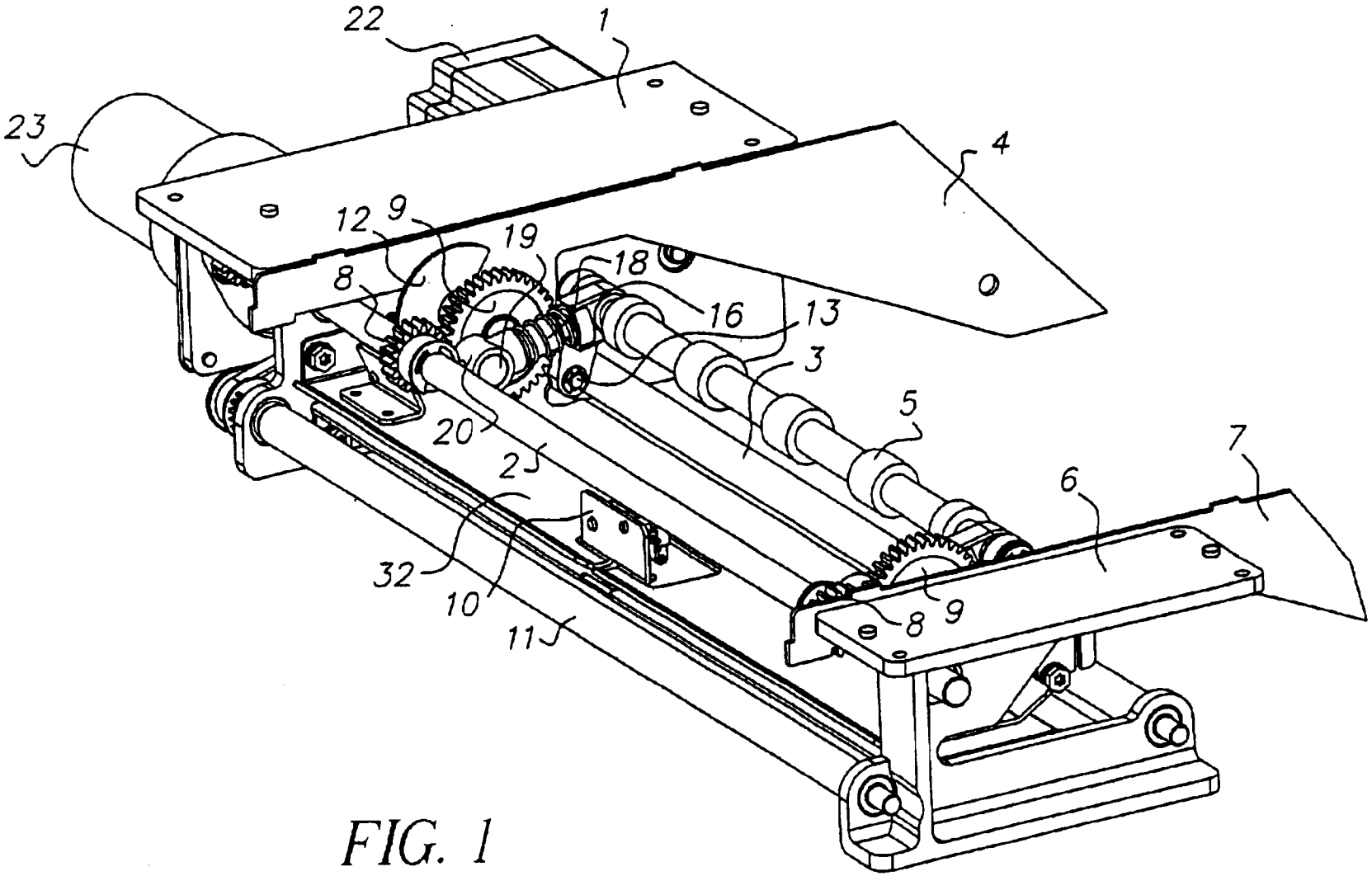
FIG. 1 is a perspective view of an embodiment of the present invention.

Referring now to the Figures, there will be disclosed an embodiment of the present invention. As shown in FIG. 1, the feed roller mechanism includes of two drive rollers (3,11) and an idler roller (5) that opens and closes onto to the fixed drive roller (3). The two drive rollers (3,11) are housed in the front mount (6) and the rear mount (1) along with a drive shaft (2). Mounted to the drive shaft (2) are two drive gears (8). The drive gears (8) engage two idler gears (9) that house the mechanism for opening and closing the idler roller (5). The idler gears (9), located at each end of the idler roller (5), are mounted to the pickup frame at weldment (4) and weldment (7). A film position sensor (10) is mounted at position in between the two drive rollers (10). Spaced guides (31 and 32) are located along a sheet transport path between drive rollers (3 and 11) for guiding a sheet driven along the path by drive rollers (3 and 11).

Figure 2:
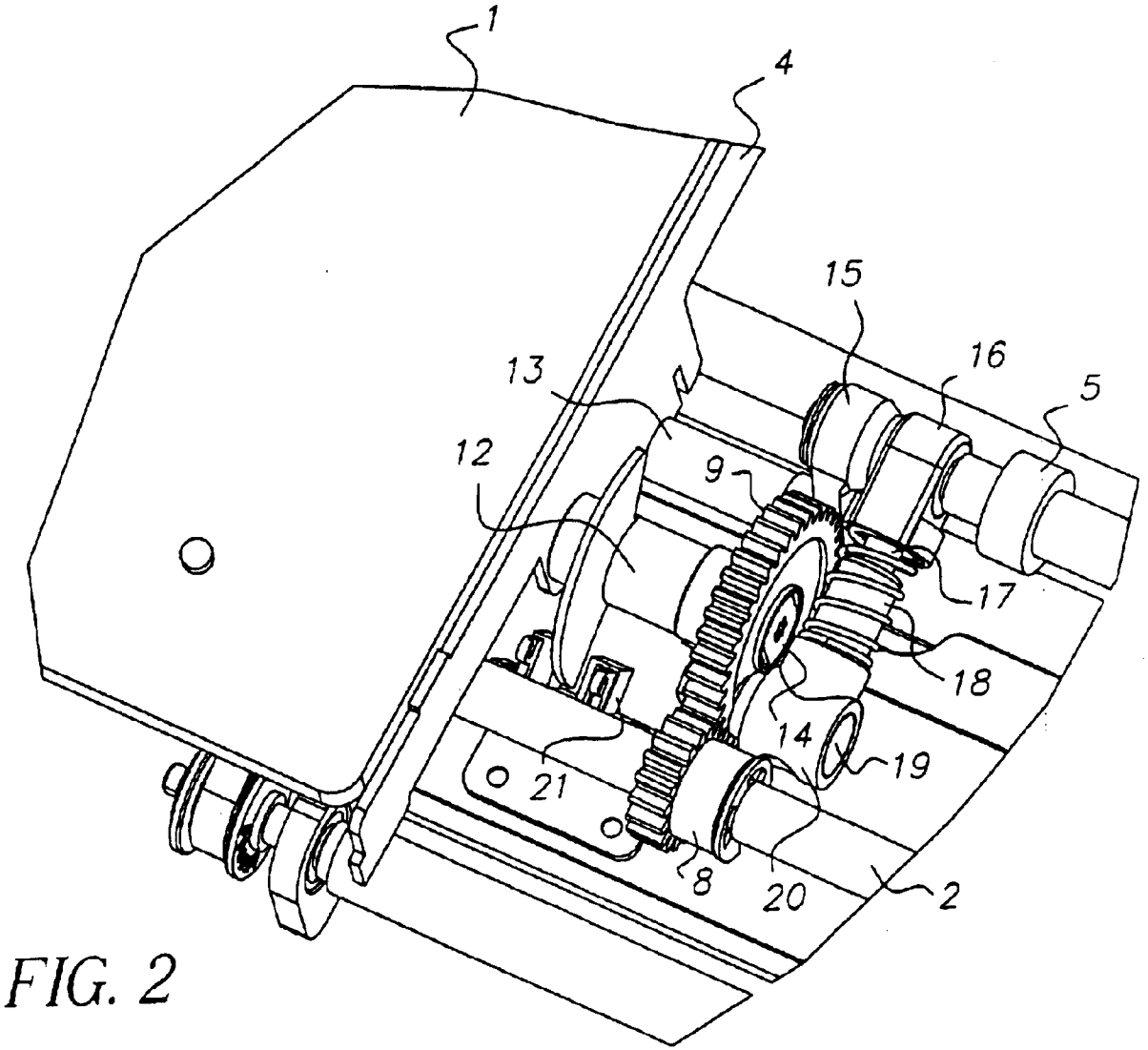
FIGS. 2 and 3 are perspective views of portions of the invention shown in FIG. 1.

FIG. 2 shows a detail view of the idler roller (5) mounting assembly. This mount assembly is on each end of the idler roller (5) providing an independent spring loaded mounting scheme. The idler gear (9) is pinned to the pickup frame using the idler pin (14) and is free to turn about this pin (14). A flag (12) also rotates about the idler pin (14) but is rotationally locked to the idler gear (9). This flag (12) is used to sense the position of the idler gear (9), and resulting idler roller (5) position, using the roller position sensor (21).

The rocker pin (19) pins the rocker (20) to the idler gear (9), the rocker (20) is free to turn about this pin. The rocker 20 is attached to the drive ring (16) with a shoulder screw (17) (see FIG. 4). The body of the shoulder screw (17) is free to slide along the inside diameter of the rocker (20), while its end is screwed into the drive ring (16). This allows the drive ring (16) and rocker (20) to move relative to each other along the axis of the shoulder screw (17). The roller spring (18), holds the drive ring (16) and rocker (20) as far apart as possible until the head of the shoulder screw (17) bottoms out on a ledge inside the rocker (20).

Inserted into the drive ring (16) is the link (15). The end of the shaft of the idler roller (5) inserts into a flanged bearing housed in the link (15) and is captivated by an e-ring. The link (15) is pinned to the pickup frame (4,7) by shaft (13) and rotates the idler roller (5) open and closed relative to the drive roller (3).

Figure 3:
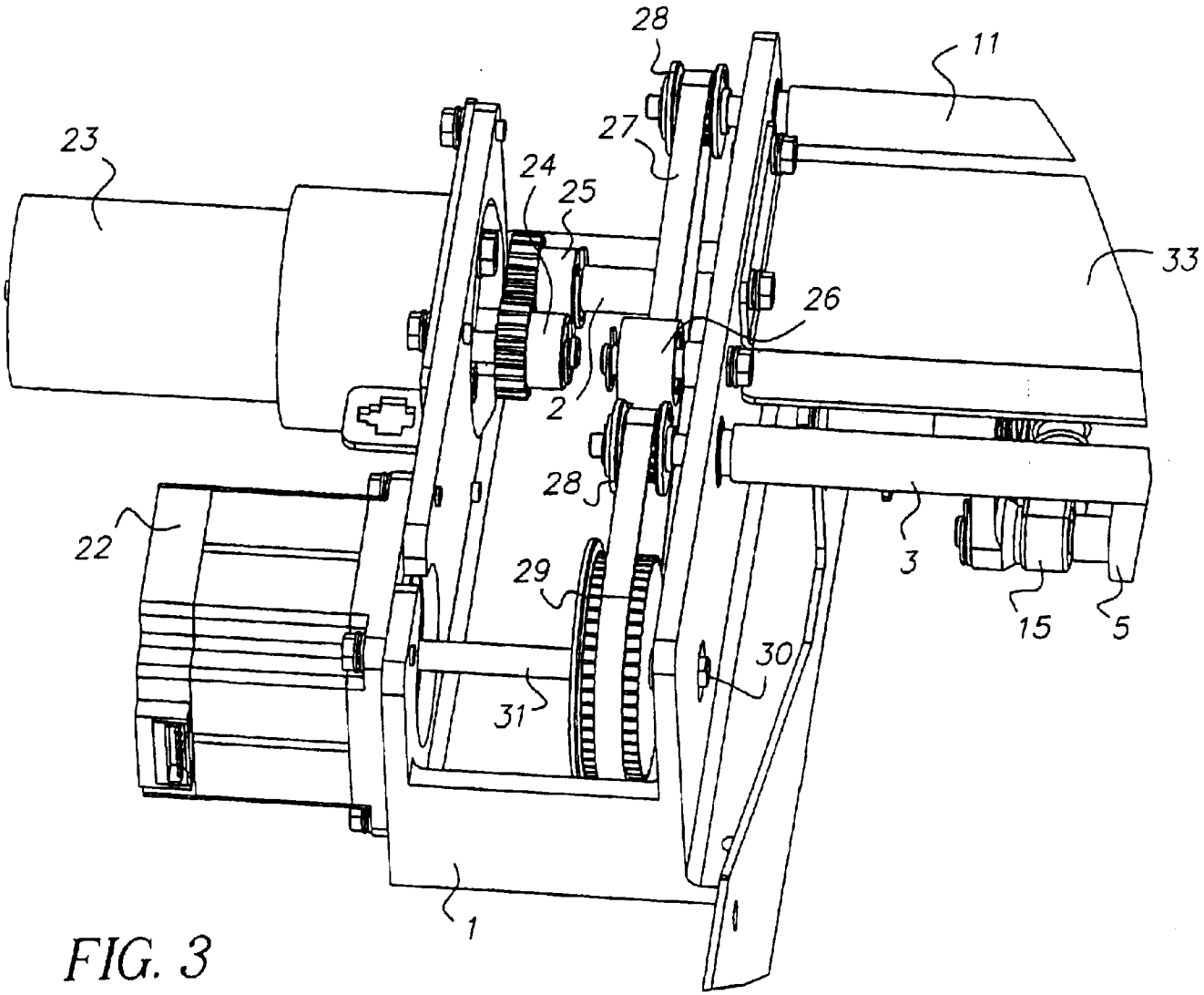

FIG. 3 shows the stepper motor (22) with a motor pulley (29) mounted to its shaft (31). Wrapped around this pulley is a toothed belt (27) that wraps around 2 drive pulleys (28) that are keyed to the ends of the two drive rollers (3,11). The belt (27) is tensioned using a fixed idler pulley (26). The two drive rollers (3,11) are driven by the stepper motor (22) with a 50 tooth to 16 tooth ratio. The dc roller motor (23) is geared to the drive shaft (2) using a pair of drive gears (24,25). This dc roller motor actuates the opening and closing of the idler roller (5) by transmitting torque through the drive shaft (2) into the drive gears (8) and into the meshed idler gears (9).

Figure 4:
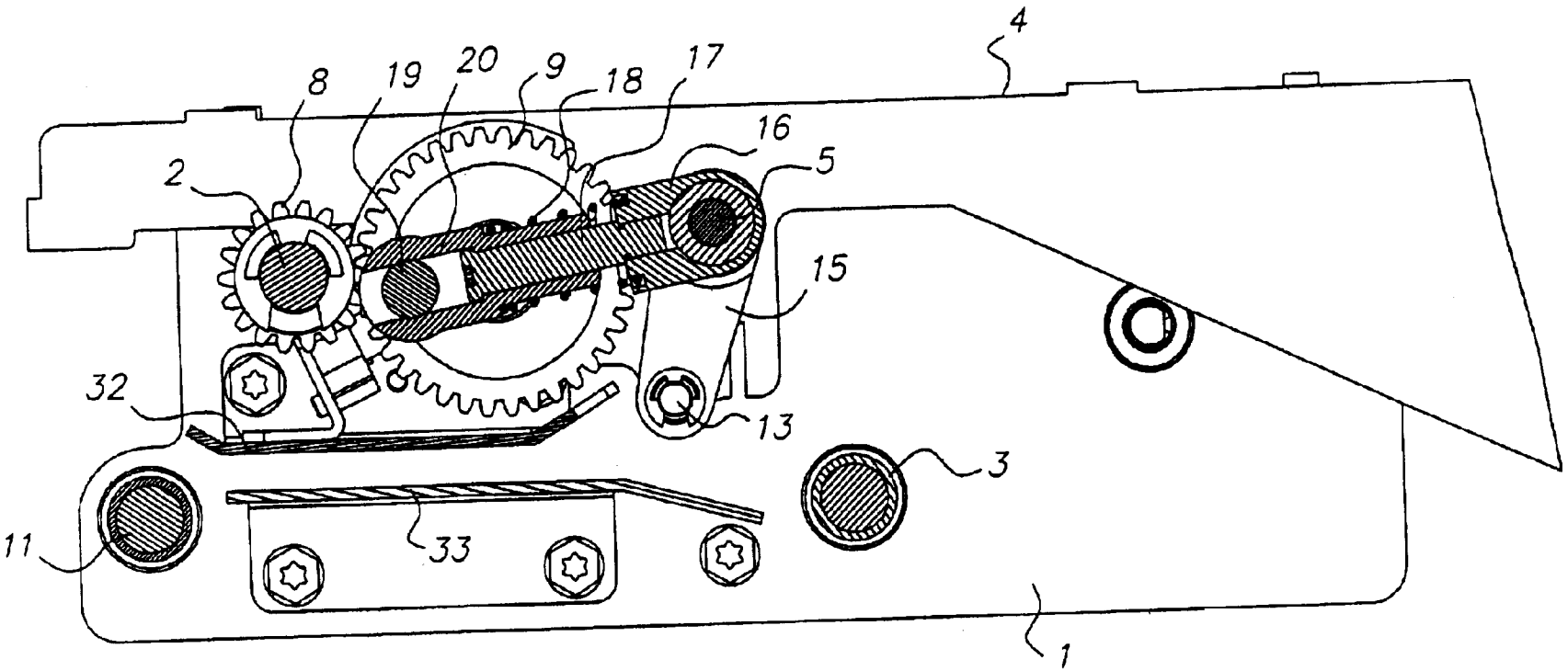
FIGS. 4–7 are side elevational views useful in describing the operation of the present invention.

Referring now to FIGS. 4–7, the operation of the present invention will be described. FIG. 4 shows the maximum open position of the Idler roller (5) relative to the drive roller (3). At this position, the rocker pin (19), which is rigidly mounted to the idler gear (9), has rotated to position of 190 degrees from horizontal. The idler gear (9) always rotates counterclockwise. The position is located by one edge of the flag (12) that engages the roller position sensor (21). As the rocker pin (19) rotates, it moves the rocker (20), shoulder screw (17), and drive ring (16) with it. The roller spring (18), holds the drive ring (16) and rocker (20) as far apart as possible until the head of the shoulder screw (17) bottoms out on a ledge inside the rocker (20). The drive ring (16) is pivotally mounted to one end of the link (15) which rotates the link (15) counterclockwise until it reaches this top dead center position. The idler roller (5), which is mounted into a ball bearing that inserts into the link (15), travels with the rotating link (5).

Figure 5:
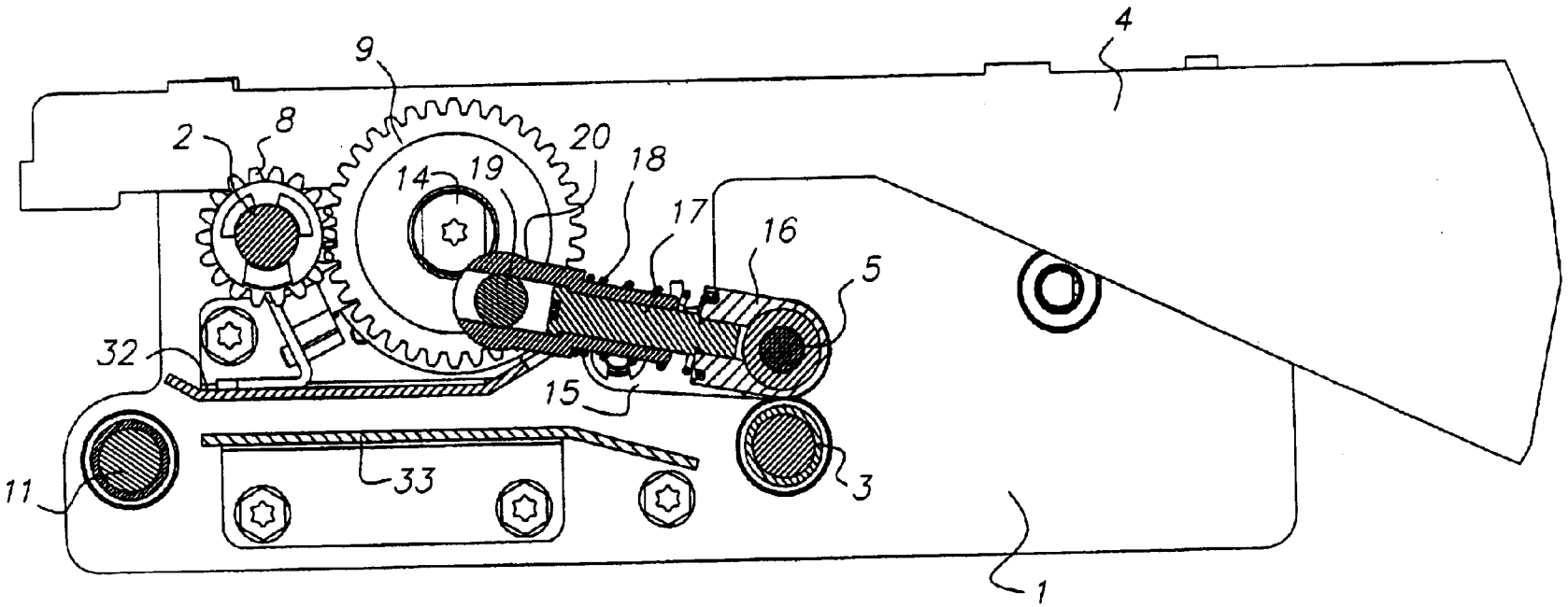

In FIG. 5, the idler gear (9) has rotated to the First Contact Position where the idler roller (5) first makes contact with the drive roller (3). In this position, the rocker pin (19) can no longer rotate counterclockwise unless the distance between the rocker pin (19) and the idler roller (5) axis is shortened. The mechanism that allows this distance to shorten is the axial motion between the shoulder screw (17) and the rocker (20). At this point, a torque load just begins to develop on the idler gear (9), prior to this point, the idler was in a no-load condition.

Figure 6:
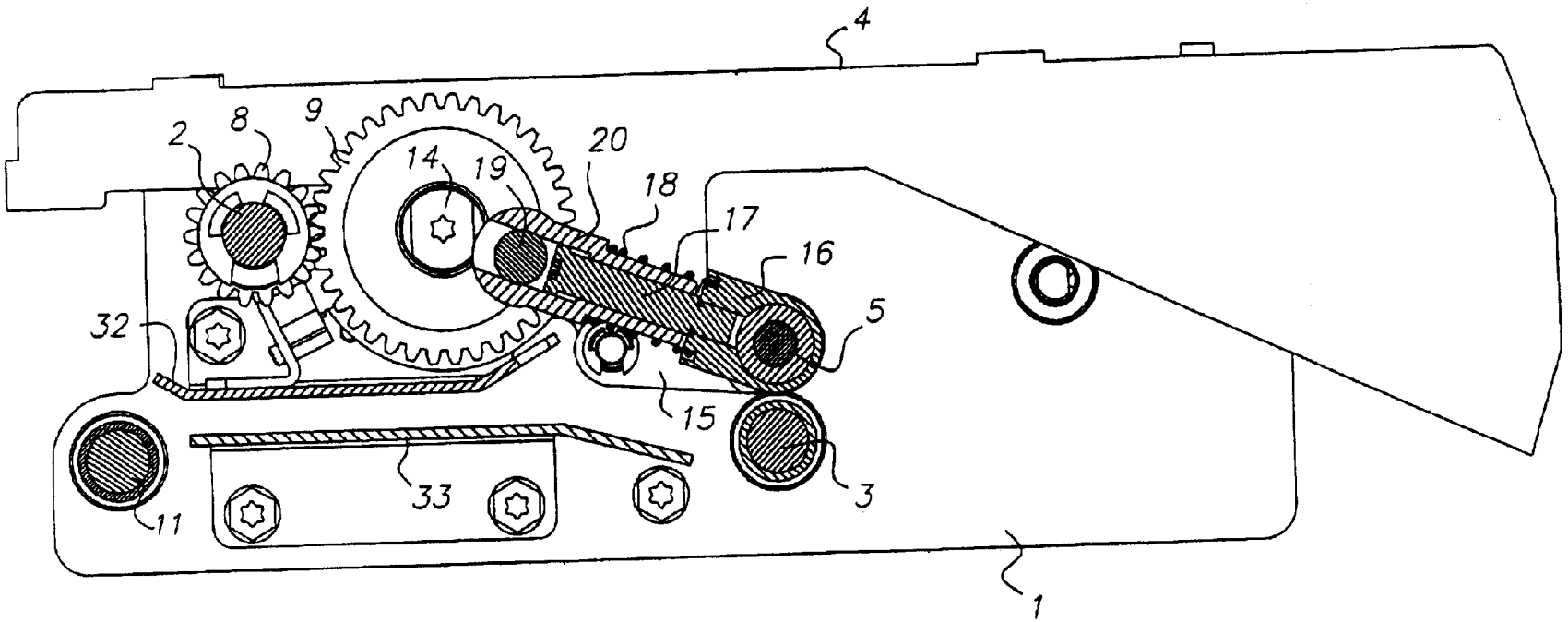

In FIG. 6, the idler gear (9) has rotated to the toggle position where the distance between the rocker pin (19) and the idler roller (5) axis is at its minimum. The shoulder screw (17) has slid axially inside the rocker (20) by a distance equal to the Spring Compression variable show in FIG. 6. At this position the spring force is at its maximum and transmits a force along the shoulder screw (17) axis that has a component of force that acts to clamp the idler roller (5) and drive roller (3) together. The torque load on the idler gear (9) in this toggle position is zero, the torque load on the idler gear (9) reached its maximum between the first contact position and the toggle position.

Figure 7:
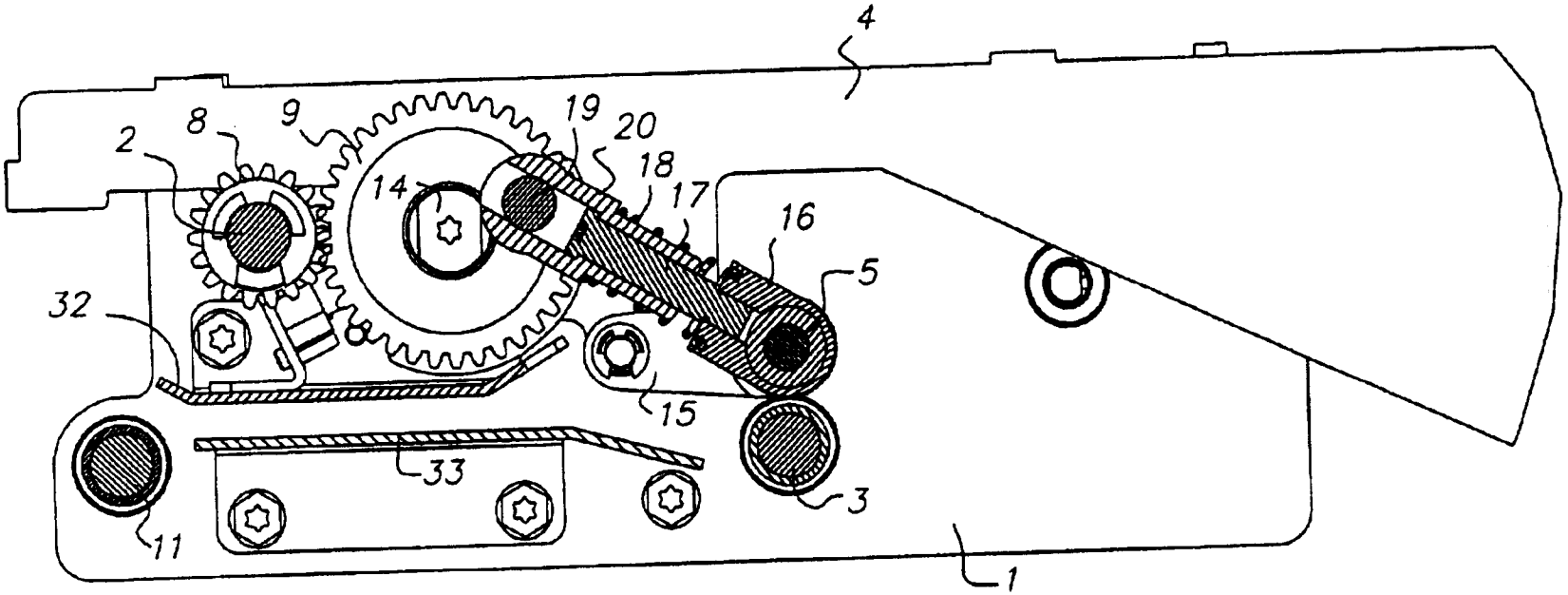

FIG. 7 shows the last contact position where the idler roller (5) is just about to lift off the drive roller (3). Here the roller spring (18) is free to expand until the Spring Compression=0 when the head of the shoulder screw (17) once again bottoms out on a ledge inside the rocker (20). At this point there is no longer any torque load on the idler gear (9). From this position, the idler gear continues to rotate counterclockwise which opens the idler roller until it returns to the maximum open position in FIG. 4.

The invention has been described in detail with particular reference to certain preferred embodiments thereof, but it will be understood that variations and modifications can be effected within the spirit and scope of the invention.

PARTS LIST

1 rear mount
2 drive shaft
3 fixed drive roller
4 weldment
5 idler roller
6 front mount
7 weldment
8 drive gears
9 idler rollers
10 film position sensor
11 drive roller
12 flag
13 shaft
14 idler pin
15 link
16 drive ring
17 shoulder screw
18 roller spring
19 rocker pin
20 rocker
22 stepper motor
23 dc roller motor
24,25 drive gears
26 fixed idler pulley
27 toothed belt
28 drive pulleys
29 motor pulley
31 drive roller shaft
32,33 guides

What is claimed is:

1. An apparatus for transporting a sheet comprising:

a first roller;

a second roller having first and second ends; and an assembly for mounting said second roller for movement between a position spaced from said first roller and a position engaging said first roller for transporting a sheet;

wherein said assembly includes independently spring loaded link assemblies respectively on said first and second ends of said second roller that ensure that said second roller will always close down on both sides of said first roller with uniform pressure on both sides, each said link assembly including: (a) an idler gear, (b) a rocker which is (i) pivotally mounted to said idler gear, (ii) mounted for slidable movement relative to said second roller, and (iii) biased away from said second roller, and (c) a link coupled to a frame and one end of said second roller.

2. The apparatus of claim 1 wherein said first roller is a drive roller and second roller is an idler roller and includes a first drive drivingly coupled to said first roller.

3. The apparatus of claim 2 further including a third roller spaced from said first roller and drivingly coupled to said first drive.

4. The apparatus of claim 3 further including spaced guides located along a sheet transport path between said first and third rollers for guiding a sheet driven along said path by said first and third rollers driven by said first drive.

5. An apparatus for transporting a sheet comprising:

a first roller;

a second roller having a first and second ends; and an assembly for moving said second roller between a position spaced from said first roller and a position engaging said first roller for transporting a sheet, said assembly including an independently mounted spring loaded link assembly disposed on each of said first and second ends of said second, each said link assembly including: (a) an idler gear, (b) a rocker pivotally mounted to said idler gear and mounted for slidable movement relative to said second roller, (c) a spring biasing said rocker away from said second roller, and (d) a link coupled to a frame and one end of said second roller.

6. The apparatus of claim 5, wherein said second roller engages said first roller with uniform pressure when said second roller engages said first roller.

7. The apparatus of claim 5, wherein the spring is a roller spring coiled about said rocker.

8. The apparatus of claim 5, further including a second drive drivingly coupled to each said idler gear of each said link assembly wherein rotation of said idler gear by said second drive causes said rocker and said link to move said second roller into engagement with said first roller, and wherein said rocker slides toward said second roller to compress said roller spring when said first and second rollers are fully engaged, thereby clamping said first and second rollers together with a clamping force which is independent on each of said first and second ends.

9. The apparatus of claim 5 wherein said first roller is a drive roller and second roller is an idler roller and includes a first drive drivingly coupled to said first roller.

10. The apparatus of claim 9 further including a third roller spaced from said first roller and drivingly coupled to said first drive.

11. The apparatus of claim 10 further including spaced guides located along a sheet transport path between said first and third rollers for guiding a sheet driven along said path by said first and third rollers driven by said first drive.

* * * * *